US006268543B1

(12) United States Patent
Sakai et al.

(10) Patent No.: US 6,268,543 B1
(45) Date of Patent: Jul. 31, 2001

(54) METHOD OF REMOVING MERCURY IN LIQUID HYDROCARBON

(75) Inventors: Tsunenori Sakai; Hidetoshi Ono; Jun Mase; Tetsuya Saruwatari, all of Yamaguchi-ken (JP)

(73) Assignee: Idemitsu Petrochemical Co., Ltd., Tokyo (JP)

( * ) Notice: Subject to any disclaimer, the term of this patent is extended or adjusted under 35 U.S.C. 154(b) by 0 days.

(21) Appl. No.: 09/435,209

(22) Filed: Nov. 5, 1999

(30) Foreign Application Priority Data

Nov. 16, 1998 (JP) ..... 10-324782
Nov. 16, 1998 (JP) ..... 10-324783

(51) Int. Cl.[7] ..... C07C 7/10; C07C 7/152; C07C 7/00; C10G 29/04

(52) U.S. Cl. ..... 585/836; 585/833; 585/877; 585/850; 585/856; 208/251 R; 208/253

(58) Field of Search ..... 208/251 R, 253; 585/833, 836, 877, 850, 856

(56) References Cited

U.S. PATENT DOCUMENTS 4,430,206 * 2/1984 Rankel ..... 208/251 R
4,915,818 * 4/1990 Yan ..... 208/251 R
4,966,683 * 10/1990 Audeh ..... 208/251 R

FOREIGN PATENT DOCUMENTS

404011691A * 1/1992 (JP) .
4-28040 5/1992 (JP) .
4-331287 11/1992 (JP) .
6-89338 11/1994 (JP) .
7-91544 10/1995 (JP) .

* cited by examiner

*Primary Examiner*—Walter D. Griffin
*Assistant Examiner*—Tam M. Nguyen
(74) *Attorney, Agent, or Firm*—Oblon, Spivak, McClelland, Maier & Neustadt, P.C.

(57) ABSTRACT

In a method of efficiently removing mercury from a liquid hydrocarbon, the liquid hydrocarbon is contacted with water contacted in advance with a crude oil and a sludge contacted in advance with a crude oil. Alternatively, the liquid hydrocarbon is contacted with a substance having ability of ionizing elemental mercury and a sulfur compound having the formula: MM'S, wherein M and M' are identical or different and are each hydrogen, alkali metal or ammonium group. When the liquid hydrocarbon to be treated contains no dissolved oxygen or contains dissolved oxygen in an amount in equilibrium with a gas containing 8% by volume of oxygen, the increase in the mercury concentration of a liquid hydrocarbon after the removing treatment is effectively prevented.

8 Claims, 1 Drawing Sheet

METHOD OF REMOVING MERCURY IN LIQUID HYDROCARBON

BACKGROUND OF THE INVENTION

1. Field of the Invention

The present invention relates to a method of removing mercury, and more specifically, to a method of efficiently removing mercury in a simple manner from a liquid hydrocarbon containing mercury.

2. Description of the Prior Art

Natural gas liquid (NGL), also referred to as natural gas condensate, obtained by removing liquefied petroleum gas from a natural gas-field product generally contains mercury in about 2 to several thousands ppb, although depending on the production areas. Therefore, liquid hydrocarbons obtained by distilling NGL often contain mercury.

When a liquid hydrocarbon containing mercury is used as row chemical materials, mercury therein deteriorates the catalytic activity of a hydrogenation catalyst or corrodes materials of apparatus because mercury forms amalgams with the catalyst components and materials of apparatus such as palladium, platinum, copper, aluminum, etc. In addition, the presence of dissolved oxygen absorbed due to NGL-air contact temporarily decreases the mercury concentration of NGL by changing the dissolved mercury to insoluble mercury in NGL. However, the insoluble mercury becomes soluble in NGL with the passage of time to increase the mercury concentration of NGL again.

Therefore, it has been keenly desired to develop a method of efficiently removing mercury from liquid hydrocarbons while preventing the mercury concentration from increasing again.

Japanese Patent Publication No. 7-91544 discloses to remove mercury using an adsorbent comprising a copper halide supported on a carrier such as activated clay. Although the mercury concentration of the treated liquid hydrocarbon is reduced to 4 to 6 ppb in some cases, only reduced to about 60 to 80 ppb in most cases. In addition, the production of the adsorbent requires many production steps such as carrying, drying and sintering steps. Further, the adsorbent is susceptible to change in its properties due to several factors to adversely affect the removal efficiency of mercury from the liquid hydrocarbon. Thus, an adsorbent having a stable mercury adsorptivity has been difficult to prepare.

Japanese Patent Application Laid-Open No. 4-331287 proposes to extract mercury by an extractant comprising water dissolving an polyhydric alcohol in an amount 3 volume % or more based on water. Although the mercury concentration of the treated liquid hydrocarbon may be 10 ppb or less in some cases, usually in insufficient level of about 10 to 30 ppb. Further, the method is extremely energy-consuming because the recovery of the polyhydric alcohol from the liquid hydrocarbon and aqueous solution and the purification of recovered polyhydric alcohol are required.

Japanese Patent Publication No. 4-28040 discloses a removing method including a step of treating a liquid hydrocarbon containing mercury with a sulfur compound represented by the formula: MM'S, wherein M and M' are identical or different and are each hydrogen, alkali metal or ammonium group, and a step of contacting the liquid hydrocarbon with an adsorbent containing at least one heavy metal sulfide. However, this method is rather complicated, because mercury is removed by blowing hydrogen sulfide gas into the liquid hydrocarbon and subsequently adsorbing mercury onto a adsorbent comprising sulfide of molybdenum and cobalt supported on alumina. Also, the adsorption step requires troublesome preparation of the adsorbent and strict control of operating conditions. Further, as noted above, the adsorbent is susceptible to change in its properties due to several factors to adversely affect the removal efficiency of mercury from the liquid hydrocarbon. Thus, the proposed method involves a difficulty of preparing an adsorbent having a stable mercury adsorptivity.

Japanese Patent Publication No. 6-89338 teaches to treat at 40° C. or higher a liquid hydrocarbon containing mercury with an aqueous solution of a sulfur compound represented by the formula: MM'Sx, wherein M is alkali metal or ammonium group, M' is hydrogen, alkali metal or ammonium group, and x is a number of 1 to 6. However, the removal of mercury is insufficient, because the mercury concentration after treatment is as high as 30 to 170 ppb when treated at 40° C. or less. Even when treated at 100 to 120° C., the residual mercury concentration is as high as 30 ppb or more, although about 30 ppb in some cases.

In addition, in the methods of Japanese Patent Publication Nos. 4-28040 and 6-89338, the mercury concentration temporarily reduced often comes to increase again.

SUMMARY OF THE INVENTION

Accordingly, an object of the present invention is to provide a method of efficiently removing mercury in simple manners from a liquid hydrocarbon containing mercury.

Another object of the present invention is to provide a simple method of efficiently removing mercury from a liquid hydrocarbon containing mercury and preventing the mercury concentration of a resultant liquid hydrocarbon from being increased again.

As a result of intensive study, the inventors have found that the above objects are achieved by contacting a liquid hydrocarbon containing mercury with water contacted in advance with a crude oil and sludge contacted in advance with a crude oil. The inventors have further found that the above objects are also achieved by contacting a liquid hydrocarbon containing mercury with a substance having ability of ionizing elemental mercury (ionizing substance) and any one of a specific sulfur compound, its aqueous solution and a crude tank liquid. In addition, as a result of continued study, the inventors have found that the mercury concentration is reduced to 1 W/V ppb or less while effectively preventing the mercury concentration of the resultant liquid hydrocarbon from being increased again when the liquid hydrocarbon contains no dissolved oxygen or contains dissolved oxygen in an amount equilibrated with a gas containing oxygen in a specific amount. The present invention has accomplished based on these findings.

Thus, in a first aspect of the present invention, there is provided a first method of removing mercury from a liquid hydrocarbon, comprising a step of contacting the liquid hydrocarbon containing mercury with water contacted in advance with a crude oil and sludge contacted in advance with a crude oil.

In a second aspect of the present invention, there is provided a second method of removing mercury from a liquid hydrocarbon containing mercury, comprising a step of contacting the liquid hydrocarbon containing mercury with a substance having ability of ionizing elemental mercury and any one of a sulfur compound represented by the formula: MM'S, wherein M and M' are identical or different and are each hydrogen, alkali metal or ammonium group, an aqueous solution of the sulfur compound and a crude oil tank liquid.

In a third aspect of the present invention, there is provide a third method of removing mercury from a liquid hydrocarbon containing mercury, in which the liquid hydrocarbon containing mercury in the second method contains no dissolved oxygen or contains dissolved oxygen in an amount equilibrated with a gas containing 8% by volume of oxygen.

DETAILED DESCRIPTION OF THE INVENTION

[1] Liquid Hydrocarbon Containing Mercury

Figure 1:
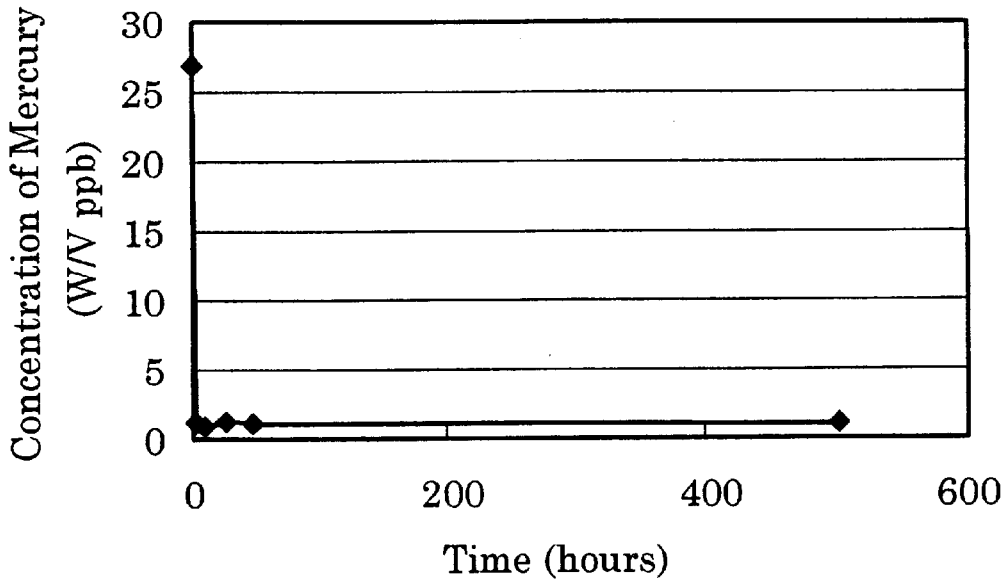
FIG. 1 is a graph showing the change with time of the mercury concentration of the liquid hydrocarbon of Example 18 during allowed to stand after mercury removal treatment.

The liquid hydrocarbon to be treated in the present invention is not specifically restricted as far as it is in liquid phase at ordinary temperature and pressure, and may include crude oil, straight run naphtha, kerosene, gas oil, vacuum distillate, topped crude, natural gas liquid, etc. In particular, natural gas liquid (NGL) is preferable.

In the present invention, any one or any mixture of crude oils produced in Saudi Arabia, United Arab Emirates, Nigeria, Canada, Mexico, Iran, Iraq, China, Kuwait, Malaysia, Venezuela, America, Australia, Russia, Libya, Philippines, Indonesia, Norway, Thai Land, Qatar, Argentina, England, and Japan may be used. The straight run naphtha, kerosene, gas oil, vacuum distillate and topped crude are obtained by processing the crude oil by known methods.

The method of the present invention may be applied to removing mercury in either of elemental form and ionic form. The mercury concentration in the liquid hydrocarbon to be treated is not specifically restricted, and usually 2 to 1000 W/V (weight/volume) ppb, preferably 5 to 100 W/V ppb.

The dissolved oxygen content in the liquid hydrocarbon to be treated is preferably 8% by volume, more preferably 6% by volume and particularly 3% by volume. Most preferred is a liquid hydrocarbon contains no dissolved oxygen.

[2] Water and Sludge Contacted with Crude Oil

The water contacted in advance with a crude oil may be naturally occurring water in a crude oil or may be water obtained, for example, by stirring a 0.0001 to 1:1 mixture (by weight) of sea water or usual water and a rude oil at 0 to 40° C. usually for 10 minutes to 72 hours before using in the removing method. The stirring time may exceed 72 hours. The water contacted with a crude oil generally contains $Cl^{31}$ , $NO_3^-$, $SO_3^{2-}$, $SO_4^{2-}$, $Na^+$, $NH_4^+$, $K^+$, $Ca^{2+}$, $Mg^{2+}$, $Fe^{2+}$, $Fe^{3+}$, etc. The sludge contacted in advance with a crude oil may be naturally occurring sludge in a crude oil, and is known from elemental analysis to contain Fe, Si, Na, Al, P, Zn, Cu, Ca, Mg, V, K, Cr, Mn, Ni, C, H, N, S, O, etc. Either of a dried sludge or a wet sludge containing a small amount of water may be used in the present invention. The water or sludge contacted with a crude oil may be used in the contacting step after separating from the crude oil or without separating from the crude oil.

[3] Ionization Substance

The substance having ability of ionizing elemental mercury in the liquid hydrocarbon (ionizing substance) may include an iron compound such as iron sulfate, iron chloride, iron sulfide, iron oxide and iron nitrate; a copper compound such as copper sulfate, copper chloride, copper oxide, copper nitrate and copper sulfide; a vanadium compound such as vanadium oxide, vanadium sulfide and vanadium sulfate; a manganese compound such as manganese oxide, manganese sulfide and manganese sulfate; a nickel compound such as nickel oxide, nickel sulfide and nickel sulfate; an inorganic peroxide such as hydrogen peroxide; an organic peroxide such as peracetic acid; atmospheric oxygen; and a crude oil tank sludge. Preferred are iron sulfate, iron sulfide, iron oxide, copper oxide, vanadium oxide and the crude oil tank sludge. The ionizing substance may be used alone or in combination of two or more.

The crude oil tank sludge referred to herein is substantially the same as those mentioned in [2], and is a sediment at the bottom of a crude oil tank containing Fe, Si, Na, Al, P, Zn, Cu, Ca, Mg, V, K, Cr, Mn, Ni, C, H, N, S, O, etc. Example of elemental analysis (weight basis) of a typical crude oil tank sludge is: 36% Fe, 1.3% Si, 3600 ppm Na, 2700 ppm Al, 2200 ppm P, 2100 ppm Zn, 950 ppm Cu, 720 ppm Ca, 550 ppm Mg, 350 ppm V, 350 ppm K, 290 ppm Cr, 230 ppm Mn, 120 ppm Ni, 32.0% C, 3.0% H, 0.9% N, 3.0% S and 0.4% Cl. Either of a dried sludge or a wet sludge containing a small amount of water may be used in the present invention.

[4] Sulfur Compound

The sulfur compound is represented by the formula:

$$MM'S,$$

wherein M and M' are identical or different and are each hydrogen, alkali metal such as sodium, potassium, lithium and cesium or ammonium group. Specific examples of the sulfur compound are hydrogen sulfide, sodium sulfide, sodium hydrosulfide, potassium sulfide, potassium hydrosulfide and ammonium sulfide. Preferred are hydrogen sulfide, sodium sulfide and sodium hydrosulfide. The solid or gaseous sulfur compound may be directly used in contacting with the liquid hydrocarbon containing mercury or may be used as an aqueous or organic solvent solution containing it in an amount of 0.1 to 100,000 W/W ppm, preferably 10 to 10,000 W/W ppm. Also, a crude oil tank liquid containing the sulfur compound, such as water containing hydrogen sulfide, may be used.

The method of removing mercury of the present invention will be described in detail below.

[I] First Preferred Method of Removing Mercury

In the first preferred method of the present invention, a liquid hydrocarbon containing mercury is brought into contact with water previously contacted with crude oil and a sludge previously contacted with crude oil. The liquid hydrocarbon may be first brought into contact with the water and subsequently with the sludge, or vice versa. Usually, the liquid hydrocarbon is contacted with the water and the sludge simultaneously.

The contact weight ratio of the water contacted with crude oil and the liquid hydrocarbon containing mercury is 0.001 to 1,000,000:100, preferably 0.1 to 50:100. The amount of the sludge used is not strictly limited, and the contact weight ratio of the sludge (dry basis) and the liquid hydrocarbon is usually 0.0000001 to 1:100.

The contacting process is carried out under ordinary pressure or increased pressure so as to maintain the liquid state of the hydrocarbon, for example, at 0 to 100° C. under ordinary pressure or 0 to 180° C. under 1 MPa.

The liquid hydrocarbon containing mercury is brought into contact with the water and sludge contacted with the crude oil by batch-wise mixing with a paddle mixer, continuous mixing with a line mixer, rotary mixing with a rotating vessel, vibration mixing, etc. The contact time is 3 seconds to 24 hours. A contact time over 24 hours produces no detrimental result, but not preferable in view of economy.

[II] Second Preferred Method of Removing Mercury

In the second preferred method of the present invention, a liquid hydrocarbon containing mercury is brought into contact with the ionizing substance and the sulfur compound each specified above. The liquid hydrocarbon may be first contacted with the ionizing substance and subsequently with the sulfur compound, or vice versa. Alternatively, the liquid hydrocarbon may be contacted with the ionizing compound and the sulfur compound simultaneously.

The weight ratio of the ionizing compound and the liquid hydrocarbon containing mercury to be contacted with each other is 0.0000001 to 100:100, preferably 0.00001 to 1:100. The sulfur compound is contacted with the liquid hydrocarbon containing mercury in a weight ratio of 0.0000001 to 100:100, preferably 0.00001 to 0.1:100. The aqueous solution or organic solvent solution of the sulfur compound is contacted with the liquid hydrocarbon containing mercury in a weight ratio of 0.001 to 1,000,000:100, preferably 0.1 to 50:100. The crude oil tank liquid is used in an amount so that the sulfur compound contained therein in total may fall within the above weight ratio range of the sulfur compound and the liquid hydrocarbon.

The same contacting temperature, contacting time and the contacting method as in the first preferred method may be applied here.

Mercury in the liquid hydrocarbon is removed as solid matter from the hydrocarbon liquid phase and the water phase by solid-liquid separation techniques such as decantation and filtration. Alternatively, the solid matter may be allowed to sediment on the bottom of vessel without separation.

[III] Third Preferred Method of Removing Mercury

In the third preferred method of the present invention, the liquid hydrocarbon containing mercury is first subjected to treatment for reducing the dissolved oxygen content, and then, subjected to the contacting treatment with the ionizing substance and the sulfur compound in the same manner as in the second preferred method.

The dissolved oxygen content is reduced by treating the liquid hydrocarbon containing mercury with a gas having an oxygen content of 8% by volume or less or with a deoxidizing agent such as sodium sulfite. A mixed gas of oxygen and nitrogen and a mixed gas of oxygen, nitrogen and carbon dioxide each having an oxygen content of 8% by volume or less may be preferably used. An example is a mixed gas of 1.7% by volume of oxygen, 97% by volume of nitrogen and 1.3% by volume of carbon dioxide. However, the kinds of mixed gas components other than oxygen and their contents in the mixed gas are not strictly specified as far as the oxygen content of the mixed gas is 8% by volume or less, and SOx, NOx, etc. may be contained in the mixed gas.

The gas having an oxygen content of 8% by volume or less is blown at 0 to 40° C. under a pressure from atmospheric pressure to 1 MPa into the liquid hydrocarbon containing mercury at a flow rate of 25 to 2500 ml/min for 0.1 to 10 hours. Alternatively, the liquid hydrocarbon containing mercury may be stored for one day to one week in a hermetically sealed container while contacting with the gas having an oxygen content of 8% by volume or less. The storage time may exceed one week. As a result thereof, the dissolved oxygen content of the liquid hydrocarbon is reduced to a level which is in equilibrium with the gas having an oxygen content of 8% by volume or less.

By blowing into the liquid hydrocarbon a gas containing no oxygen such as nitrogen gas under the same conditions as above, by storing the liquid hydrocarbon in a hermetically sealed container while contacting it with a gas containing no oxygen, or by mixing the deoxidizing agent with the liquid hydrocarbon, the dissolved oxygen content of the liquid hydrocarbon is reduced to substantially zero.

The liquid hydrocarbon thus treated is then subjected to the contacting treatment with the ionizing substance and the sulfur compound in the same manner as in the second preferred method.

The weight ratio of the sulfur compound and the liquid hydrocarbon containing mercury to be contacted with each other is 0.0000001 to 1,000,000:100, preferably 0.00001 to 50:100. The ionizing substance is contacted with the liquid hydrocarbon containing mercury in a weight ratio of 0.00001 to 100:100, preferably 0.0001 to 0.1:100. The aqueous solution or organic solvent solution of the sulfur compound or the crude oil tank liquid is used in an amount so that the sulfur compound contained therein in total may fall within the above range of the weight ratio of the sulfur compound and the liquid hydrocarbon.

The present invention will be explained in more detail by reference to the following examples which should not be construed to limit the scope of the present invention.

EXAMPLE 1

Each of 5 kinds of crude oils was contacted with water in a weight ratio of 1000:1, and then, the contacted water was separated from the crude oil. Into a 100-ml Teflon® vessel, 1 part by weight of the contacted water, 3 parts by weight of NGL containing 27 W/V ppb of mercury and 0.0006 part by weight of dried sludge contacted in advance with a crude oil were charged. After stirring the contents at ordinary temperature for 7 hours using a magnetic stirrer, the resultant mixture was allowed to stand. The measured mercury concentration of the resultant NGL was 1 W/V ppb or less in each case.

EXAMPLE 2

A crude oil and water were contacted with each other in a weight ratio of 1000:1, and then, the contacted water was separated from the crude oil. Into a 100-ml Teflon® vessel, 1 part by weight of the contacted water, 3 parts by weight of NGL and 0.0006 part by weight of a dried sludge contacted in advance with a crude oil were charged. Three kinds of NGL containing 27 W/V ppb, 18 W/V ppb or 5 W/V ppb of mercury were used. After stirring the contents at ordinary temperature for 7 hours using a magnetic stirrer, the resultant mixture was allowed to stand. The measured mercury concentration of the resultant NGL was 1 W/V ppb or less in each case.

EXAMPLE 3

The procedures of Example 1 were repeated while changing the charged amount of the water contacted in advance with a crude oil to 0.001 part by weight. The measured mercury concentration of the resultant NGL was 1 W/V ppb or less in each case.

EXAMPLE 4

The procedures of Example 1 were repeated while changing the charged amount of the water contacted in advance with a crude oil to 0.01 part by weight. The measured mercury concentration of the resultant NGL was 1 W/V ppb or less in each case.

EXAMPLE 5

The procedures of Example 1 were repeated while changing NGL to n-hexane dissolving 30 W/V ppb elemental mercury. The measured mercury concentration of the resultant n-hexane was 1 W/V ppb or less in each case.

EXAMPLE 6

The procedures of Example 1 were repeated while changing NGL to n-hexane dissolving 95 W/V ppb mercury chloride. The measured mercury concentration of the resultant n-hexane was 1 W/V ppb or less in each case.

EXAMPLE 7

The procedures of Example 1 were repeated while changing NGL to n-hexane dissolving 220 W/V ppb di-n-dodecylthiomercury. The measured mercury concentration of the resultant n-hexane was 1 W/V ppb or less in each case.

EXAMPLE 8

Into a 100-ml Teflon® vessel, 1 part by weight of naturally occurring water in crude oil, 3 parts by weight NGL containing 27 W/V ppb mercury and 0.0006 part by weight a dried sludge contacted in advance with a crude oil were charged. After stirring the contents at ordinary temperature for 7 hours using a magnetic stirrer, the resultant mixture was allowed to stand. The measured mercury concentration of the resultant NGL was 1 W/V ppb or less.

Comparative Example 1

The procedures of Example 1 were repeated while changing the water contacted in advance with crude oil to an ion-exchanged water. After stirring the contents at ordinary temperature for 7 hours using a magnetic stirrer, the resultant mixture was allowed to stand. The measurement showed that the mercury concentration of the resultant NGL remained unchanged from 27 W/V ppb in each case. Although the stirring was continued for 24 hours, the mercury concentration of NGL still remained unchanged from 27 W/V ppb in each case.

Comparative Example 2

The procedures of Example 1 were repeated while changing the water contacted in advance with crude oil to sea water. After stirring the contents at ordinary temperature for 7 hours using a magnetic stirrer, the resultant mixture was allowed to stand. The measurement showed that the mercury concentration of the resultant NGL remained unchanged from 27 W/V ppb in each case. Although the stirring was continued for 24 hours, the mercury concentration of NGL still remained unchanged from 27 W/V ppb in each case.

Comparative Example 3

The procedures of Example 1 were repeated while changing the water contacted in advance with crude oil to 10% by weight aqueous solution of triethylene glycol. After stirring the contents at ordinary temperature for 7 hours using a magnetic stirrer, the resultant mixture was allowed to stand. The measurement showed that the mercury concentration of the resultant NGL remained unchanged from 27 W/V ppb in each case. Although the stirring was continued for 24 hours, the mercury concentration of NGL still remained unchanged from 27 W/V ppb in each case.

Comparative Example 4

The procedures of Example 1 were repeated while changing the water contacted in advance with crude oil to 1% by weight aqueous solution of acetic acid. After stirring the contents at ordinary temperature for 7 hours using a magnetic stirrer, the resultant mixture was allowed to stand. The measurement showed that the mercury concentration of the resultant NGL remained unchanged from 27 W/V ppb in each case. Although the stirring was continued for 24 hours, the mercury concentration of NGL still remained unchanged from 27 W/V ppb in each case.

Reference Example 1

Into a 100 ml Teflon® vessel, 3 parts by weight of NGL containing 19 W/V ppb elemental mercury and 8 W/V ppb ionic mercury and 0.00006 part by weight of each ionizing substance shown in Table 1 were charged The contents were stirred at ordinary temperature for 7 hours using a magnetic stirrer. Thereafter, the concentrations of elemental mercury and ionic mercury in the treated NGL were measured. The results are shown in Table 1.

TABLE 1

| Ionizing Substance | | | | | | | |
|---|---|---|---|---|---|---|---|
| Iron (II) sulfate | Iron (III) sulfate | Iron (III) sulfide | Iron (II) iron (III) oxide | Copper (I) oxide | Vanadium (V) oxide | Nickel oxide | Manganese oxide |
| Elemental Hg (W/V ppb) | | | | | | | |
| 0 | 0 | 0 | 5 | 5 | 7 | 10 | 2 |
| Ionic Hg (W/V ppb) | | | | | | | |
| 27 | 27 | 27 | 22 | 22 | 20 | 17 | 25 |

Reference Example 2

Into a 100 ml Teflon® vessel, 3 parts by weight of NGL containing 19 W/V ppb elemental mercury and 8 W/V ppb ionic mercury and 0.0006 part by weight of a dried crude oil tank sludge were charged, and the contents were stirred at ordinary temperature for 7 hours using a magnetic stirrer. Thereafter, the concentrations of elemental mercury and ionic mercury in the treated NGL were measured. The results showed that all the elemental mercury were ionized.

EXAMPLE 9

Into a 100 ml Teflon® vessel, 1 part by weight an aqueous solution containing 10 W/W ppm hydrogen sulfide, 3 parts by weight of NGL containing 27 W/V ppb mercury and 0.00006 part by weight of each iron compound selected from iron (II) sulfate, iron (III) sulfate, iron (III) sulfide and iron (II) iron (III) oxide were charged. After stirring the contents at ordinary temperature for 7 hours using a magnetic stirrer, the resultant mixture was allowed to stand. The measured mercury concentration of the resultant NGL was 1 W/V ppb or less in each case.

EXAMPLE 10

The procedures of Example 9 were repeated while changing the iron compound to copper (II) oxide. The measured mercury concentration of the resultant NGL was 1 W/V ppb or less.

EXAMPLE 11

Into a 100 ml Teflon® vessel, 1 part by weight of each aqueous solution containing 100, 500, 1,000 or 10,000 W/W ppb hydrogen sulfide, 3 parts by weight of NGL containing 27 W/V ppb mercury and 0.00006 part by weight of a dried crude oil tank sludge were charged. After stirring the contents at ordinary temperature for 7 hours using a magnetic stirrer, the resultant mixture was allowed to stand. The measured mercury concentration of the resultant NGL was 1 W/V ppb or less in each case.

EXAMPLE 12

Into a 100 ml Teflon® vessel, 1 part by weight of an aqueous solution containing 1 W/W ppm sodium hydrosulfide, 3 parts by weight of NGL containing 27 W/V ppb mercury and 0.0006 part by weight of a dried crude oil tank sludge were charged. After stirring the contents at ordinary temperature for 7 hours using a magnetic stirrer, the resultant mixture was allowed to stand. The measured mercury concentration of the resultant NGL was 1 W/V ppb or less.

EXAMPLE 13

Into a 100 ml Teflon® vessel, 1 part by weight of an aqueous solution containing 0.1 W/W ppm sodium sulfide, 3 parts by weight of NGL containing 27 W/V ppb mercury and 0.0006 part by weight of a dried crude oil tank sludge were charged. After stirring the contents at ordinary temperature for 7 hours using a magnetic stirrer, the resultant mixture was allowed to stand. The measured mercury concentration of the resultant NGL was 1 W/V ppb or less.

Comparative Example 5

The procedures of Example 9 were repeated while changing the aqueous solution of hydrogen sulfide to an ion-exchanged water. After stirring the contents at ordinary temperature for 7 hours using a magnetic stirrer, the resultant mixture was allowed to stand. The measurement showed that the mercury concentration of the resultant NGL remained unchanged from 27 W/V ppb in each case. Although the stirring was continued for 24 hours, the mercury concentration of NGL still remained unchanged from 27 W/V ppb in each case.

Comparative Example 6

The procedures of Example 9 were repeated while changing the aqueous solution of hydrogen sulfide to sea water. After stirring the contents at ordinary temperature for 7 hours using a magnetic stirrer, the resultant mixture was allowed to stand. The measurement showed that the mercury concentration of the resultant NGL remained unchanged from 27 W/V ppb in each case. Although the stirring was continued for 24 hours, the mercury concentration of NGL still remained unchanged from 27 W/V ppb in each case.

Comparative Example 7

The procedures of Example 9 were repeated while omitting the use of the iron compound. After stirring the contents at ordinary temperature for 7 hours using a magnetic stirrer, the resultant mixture was allowed to stand. The measurement showed that the mercury concentration of the resultant NGL remained unchanged from 27 W/V ppb.

EXAMPLE 14

Into a 100 ml Teflon® vessel, 0.000015 part by weight of hydrogen sulfide gas, 3 parts by weight of NGL containing 27 W/V ppb mercury and 0.00003 part by weight of iron (II) iron (III) oxide were charged. After stirring the contents at ordinary temperature for 7 hours using a magnetic stirrer, the resultant mixture was allowed to stand. The measured mercury concentration of the resultant NGL was 1 W/V ppb or less.

EXAMPLE 15

The procedures of Example 14 were repeated while changing iron (II) iron (III) oxide to iron sulfide. The measured mercury concentration of the resultant NGL was 1 W/V ppb or less.

EXAMPLE 16

The procedures of Example 14 were repeated while changing 0.00003 part by weight of iron (II) iron (III) oxide to 0.00006 part by weight of copper (II) sulfate. The measured mercury concentration of the resultant NGL was 1 W/V ppb or less.

EXAMPLE 17

The procedures of Example 14 were repeated while changing iron (II) iron (III) oxide to a crude oil tank sludge. The measured mercury concentration of the resultant NGL was 1 W/V ppb or less.

Reference Example 3

Mixed gas A consisting of 8% by volume of oxygen and 92% by volume of nitrogen was blown at 25° C. under a pressure of 0.1 MPa into 500 ml of mercury-containing NGL charged in a carbon steel vessel at a flow rate of 250 ml/min for one hour. The dissolved oxygen content of the resultant NGL was represented by "C'." Separately, air was blown into the NGL in the same manner as above, and the dissolved oxygen content of the resultant NGL was represented by "C'." The value of C/C' was 0.38. The values of C/C' obtained for other mixed gases B to E are shown in Table 2.

TABLE 2

| | Concentration of Gas Components (vol. %) | | | | |
|---|---|---|---|---|---|
| Mixed Gas | Oxygen | Nitrogen | $CO_2$ | CO | C/C' |
| A | 8 | 92 | 0 | 0 | 0.38 |
| B | 0 | 100 | 0 | 0 | 0.00 |
| C | 2 | 98 | 0 | 0 | 0.10 |
| D | 5 | 95 | 0 | 0 | 0.24 |
| E | 1.7 | 97.0 | 1.0 | 0.3 | 0.081 |

Reference Example 4

Mixed gas A consisting of 8% by volume of oxygen and 92% by volume of nitrogen was blown at 25° C. under a pressure of 0.1 MPa into 500 ml of mercury-containing NGL charged in a Teflon® vessel at a flow rate of 250 ml/min for one hour. The value of C/C' of the resultant NGL was 0.38.

Reference Example 5

In a Teflon® vessel, 500 ml of NGL containing mercury and 5g of sodium sulfite were mixed by stirring for one hour. The value of C/C' of the resultant NGL was 0.00.

EXAMPLE 18

Into a carbon steel vessel, 2 parts by weight of an aqueous solution containing 700 ppm hydrogen sulfide, 1000 parts by weight of NGL (C/C'=0.00) containing 27 W/V ppb mercury and 0.01 part by weight of iron (II) iron (III) oxide were charged. The contents were stirred for 3 hours to carry out the mercury removal treatment. Thereafter, the resultant NGL was filtered through a membrane filter having 0.45 $\mu$m pore size to remove solid matters. The mercury concentration of NGL after filtration was 1 W/V ppb or less. The mercury concentration was kept 1 W/V ppb or less even after allowed to stand for three weeks. The change of the mercury concentration with time during the standing is shown in FIG. 1.

EXAMPLE 19

The procedures of Example 18 were repeated while changing the carbon steel vessel to a Teflon® vessel. The mercury concentration of NGL after 3-hour stirring was 1 W/V ppb or less. The mercury concentration was kept 1 W/V ppb or less even after allowed to stand for three weeks.

EXAMPLE 20

The procedures of Example 18 were repeated while changing 2 parts by weight aqueous solution containing 700 ppm hydrogen sulfide to 0.0014 part by weight of hydrogen sulfide gas. The mercury concentration of NGL after 3-hour stirring was 1 W/V ppb or less. The mercury concentration was kept 1 W/V ppb or less even after allowed to stand for three weeks.

EXAMPLES 21–23

The procedures of Example 18 were repeated while changing the mercury-containing NGL having a C/C' value of 0.00 to a mercury-containing NGL having a C/C' value of 0. 10 (Example 21),a mercury-containing NGL having a C/C' value of 0.24 (Example 22) or a mercury-containing NGL having a C/C' value of 0.081 (Example 23). The mercury concentration of NGL after 3-hour stirring was 1 W/V ppb or less in each case. Further, the mercury concentration was kept 1 W/V ppb or less even after allowed to stand for three weeks in each case.

Comparative Example 8

A gas containing 21% by volume of oxygen was blown at 25° C. under a pressure of 0.1 MPa into 500 ml of a mercury-containing NGL charged in a carbon steel vessel at a flow rate of 250 ml/minute for one hour. The value of C/C' of the resultant NGL was 1.00.

Figure 2:
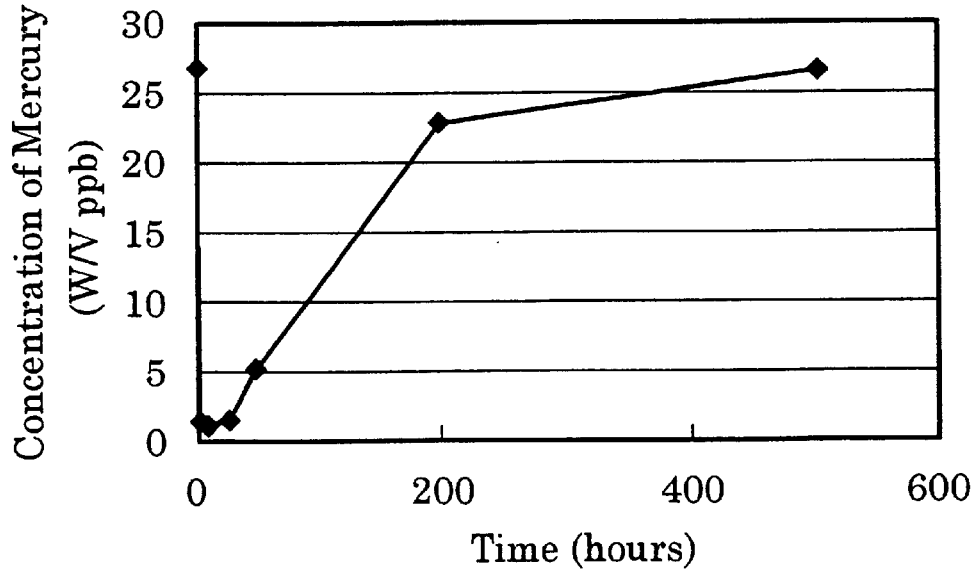
FIG. 2 is a graph showing the change with time of the mercury concentration of the liquid hydrocarbon of Comparative Example 8 during allowed to stand after mercury removal treatment.

Then, the procedures of Example 18 were repeated while changing the mercury-containing NGL having a C/C' value of 0.00 to a mercury-containing NGL having a C/C' value of 1.00 prepared above. The mercury concentration of NGL after 3-hour stirring was 1 W/V ppb or less. Upon allowing to stand, the mercury concentration of NGL began to increase after 21 hours and reached about 27 W/V ppb after three weeks. The change of the mercury concentration with time during the standing is shown in FIG. 2.

As described in detail, the mercury concentration of a liquid hydrocarbon is reduced to 1 W/V ppb or less in extremely simple manner. In addition, the increase of the mercury concentration after the removing treatment is also prevented.

What is claimed is:

1. A method of removing mercury from a liquid hydrocarbon, comprising:

a step of contacting the liquid hydrocarbon containing mercury with water contacted in advance with a crude oil and a sludge contacted in advance with said crude oil;

wherein the water contacted in advance with said crude oil contains at least one ion selected from the group consisting of $Cl^-$, $NO_3^-$, $SO_3^{2-}$, $SO_4^{2-}$, $Na^+$, $NH_4^+$, $K^+$, $Ca^{2+}$, $Mg^{2+}$, $Fe^{2+}$ and $Fe^{3+}$; and wherein the sludge contacted in advance with said crude oil contains at least one element selected from the group consisting of Fe, Si, Na, Al, P, Zn, Cu, Ca, Mg, V, K, Cr, Mn, Ni, C, H, N, S, O and Cl.

2. The method of removing mercury from a liquid hydrocarbon according to claim 1, wherein the water contacted in advance with said crude oil is contacted with the liquid hydrocarbon containing mercury in a weight ratio of 0.001 to 1,000,000:100; and the sludge contacted in advance with the crude oil is contacted with the liquid hydrocarbon containing mercury in a weight ratio of 0.0000001 to 1:100.

3. A method of removing mercury from a liquid hydrocarbon, comprising:

a step of contacting the liquid hydrocarbon containing mercury with a substance having an ability of ionizing elemental mercury in the liquid hydrocarbon and any one of a sulfur compound represented by the formula:

MM'S wherein M and M' are identical or different and are each hydrogen, alkali metal or ammonium group, an aqueous solution of the sulfur compound and a crude oil tank liquid containing the sulfur compound; and wherein the substance having the ability of ionizing elemental mercury is at least one substance selected from the group consisting of an iron compound, a copper compound, a vanadium compound, a manganese compound, a nickel compound, an inorganic peroxide, an organic peroxide, atmospheric oxygen and a crude oil tank sludge.

4. The method of removing mercury from a liquid hydrocarbon according to claim 3, wherein the substance having the ability of ionizing elemental mercury is at least one compound selected from the group consisting of iron sulfate, iron sulfide, iron oxide, copper oxide, vanadium oxide and the crude oil tank sludge.

5. The method of removing mercury from a liquid hydrocarbon according to claim 3, wherein the sulfur compound represented by the formula: MM'S is at least one compound selected from the group consisting of hydrogen sulfide, sodium sulfide and sodium hydrosulfide.

6. The method of removing mercury from a liquid hydrocarbon according to claim 3, wherein the substance having the ability of ionizing elemental mercury is contacted with the liquid hydrocarbon containing mercury in a weight ratio of 0.0000001 to 100:100; and the sulfur compound is contacted with the liquid hydrocarbon containing mercury in a weight ratio of 0.0000001 to 100:100.

7. The method of removing mercury from a liquid hydrocarbon according to claim 3, wherein the liquid hydrocarbon containing mercury being subjected to the contacting treatment contains no dissolved oxygen or contains dissolved oxygen in an amount in equilibrium with a gas having an oxygen content of 8% by volume or less.

8. The method of removing mercury from a liquid hydrocarbon according to claim 7, wherein the sulfur compound is contacted with the liquid hydrocarbon containing mercury in a weight ratio of 0.0000001 to 1,000,000:100; and the substance having the ability of ionizing elemental mercury is contacted with the liquid hydrocarbon containing mercury in a weight ratio of 0.00001 to 100:100.

* * * * *